US010024144B2

(12) United States Patent
Santeler

(10) Patent No.: US 10,024,144 B2
(45) Date of Patent: Jul. 17, 2018

(54) THICK WALL SHOULDERED LAUNCHER

(71) Applicant: Weatherford Technology Holdings, LLC, Houston, TX (US)

(72) Inventor: Darren Richard Santeler, Katy, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 557 days.

(21) Appl. No.: 14/201,587

(22) Filed: Mar. 7, 2014

(65) Prior Publication Data

US 2014/0262345 A1 Sep. 18, 2014

Related U.S. Application Data

(60) Provisional application No. 61/790,157, filed on Mar. 15, 2013.

(51) Int. Cl.
*E21B 17/20* (2006.01)
*E21B 43/10* (2006.01)

(52) U.S. Cl.
CPC ..... *E21B 43/103* (2013.01); *E21B 43/105* (2013.01)

(58) Field of Classification Search
CPC ..... E21B 43/103; E21B 43/105; E21B 43/108
See application file for complete search history.

(56) References Cited

U.S. PATENT DOCUMENTS 6,745,846 B1 * 6/2004 Innes ..... B21D 39/08 166/115
2009/0065196 A1 3/2009 Holland et al.
2010/0101072 A1 4/2010 Cook et al.
2010/0270035 A1 * 10/2010 Ring ..... E21B 43/103 166/384
2012/0298379 A1 * 11/2012 Van Riet ..... E21B 43/105 166/382
2013/0140022 A1 * 6/2013 Leighton ..... E21B 29/10 166/277

FOREIGN PATENT DOCUMENTS

WO 2001018353 A1 3/2001

OTHER PUBLICATIONS

PCT International Search Report and Written Opinion for Application PCT/US2014/025448, dated Jul. 7, 2014.
Canadian Office Action dated Aug. 19, 2016, for Canadian Patent Application No. 2,904,351.

* cited by examiner

*Primary Examiner* — Nicole Coy
(74) *Attorney, Agent, or Firm* — Patterson & Sheridan, LLP

(57) ABSTRACT

An expandable tubular system that includes a launcher section coupled to a tubular string and that houses an expansion device. A shoulder section that is formed at a transition point between the launcher section and the tubular string has a wall thickness greater than the wall thicknesses of the tubular string and the launcher section. The shoulder section has an inner diameter less than inner diameters of the launcher section and the tubular string. The shoulder section is arranged to increase the force required to begin expansion of the tubular string and increase the contact area between the inner surface of the shoulder section the expansion device when supporting the weight of the tubular string.

12 Claims, 4 Drawing Sheets

THICK WALL SHOULDERED LAUNCHER

CROSS REFERENCE TO RELATED APPLICATION

This application claims benefit of U.S. Provisional Application No. 61/790,157, filed Mar. 15, 2013, the contents of which are herein incorporated by reference in their entirety.

BACKGROUND OF THE INVENTION

Field of the Invention

Embodiments of the invention generally relate expandable liner systems.

Description of the Related Art

In the drilling of oil and gas wells, a wellbore is formed using a drill bit that is urged downwardly at a lower end of a drill string. After drilling a predetermined depth, the drill string and bit are removed and the wellbore is lined with a string of tubulars for structural support. Expandable tubular members, such as expandable liners, are often used to line the wellbore.

Generally, the expandable tubular string is supported at its lower end by an upward facing expansion cone as it is lowered into the wellbore. The weight of the expandable tubular string is supported by and rides on the expansion cone face. The maximum weight and corresponding length of the expandable tubular string that can be run in on the expansion cone is thus set by the expansion force required to start expansion. Any amount of force greater than this allowable limit that is supported by the expansion cone would literally cause the expandable tubular string to expand under its own weight.

Therefore, there is a need for new and/or improved expandable liner systems that can handle heavy weight and long length expandable tubular strings.

SUMMARY OF THE INVENTION

An expandable tubular system having a thick wall section that effectively increases the expansion force required to initiate expansion of an expandable tubular string that is supported by an expansion device.

In one embodiment, an expandable tubular system may comprise an expandable tubular string; a launcher section coupled to the tubular string and that houses an expansion device; and a shoulder section forming a transition point between the launcher section and the tubular string, wherein the shoulder section has a wall thickness greater than the wall thicknesses of the tubular string and the launcher section, and wherein the shoulder section has an inner diameter less than inner diameters of the launcher section and the tubular string. An upper face of the expansion device may contact an inner surface of the shoulder section for supporting the weight of the tubular string from the surface via a work string.

In one embodiment, a method of expanding a tubular string may comprise lowering the tubular string into a wellbore using an expansion device that is supported from the surface via a work string, wherein the expansion device is disposed in a launcher section that is coupled to the tubular string; supporting the weight of the tubular string in the wellbore on an upper face of the expansion device, wherein the upper face of the expansion device contacts an inner surface of a shoulder section that forms a transition point between the launcher section and the tubular string, wherein the shoulder section has a wall thickness greater than wall thicknesses of the tubular string and the launcher section, and wherein the shoulder section has an inner diameter that is less than the inner diameters of the launcher section and the tubular string; and expanding the tubular string using the expansion device.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Although some of the embodiments of the invention are described with respect to expanding a tubular member in a wellbore using an expansion device, the embodiments described herein may be used with other tubular expansion type systems and devices.

Figure 1:
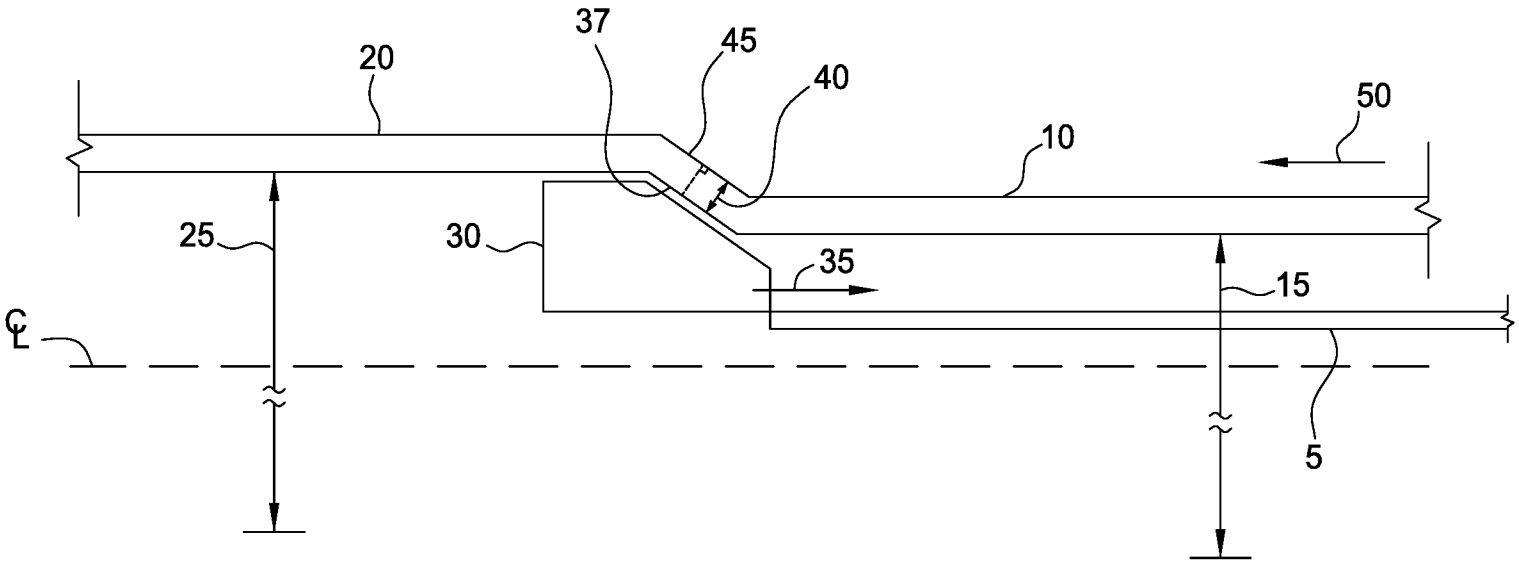
FIG. 1 PRIOR ART
FIG. 1 illustrates an expandable tubular string supported by an expansion cone.

FIG. 1 illustrates a sectional view of an expandable tubular string 10 (such as one or more liner sections threadedly coupled together) having an expansion device launcher section 20 disposed at the lower end of the tubular string 10 for housing a expansion device 30, such as an expansion cone. The launcher section 20 has an inner diameter 25 that is greater than an inner diameter 15 of the tubular string 10, and may be formed integral with or coupled to the end of the tubular string 10. A shoulder 45 section is formed at the transition area from the launcher section 20 to the tubular string 10. As illustrated, the wall thickness of the launcher section 20 and the expandable tubular string 10, including the wall thickness 40 of the shoulder 45, is substantially uniform along the length of the launcher section and the tubular string 10.

Generally, the expandable tubular string 10 is lowered into a wellbore and subsequently expanded by moving the expansion device 30 through the tubular string 10. Prior to expansion and/or when lowered into the wellbore, the weight 50 of the tubular string 10 is supported by the expansion device 30, which is supported from the surface by a work string 5. The weight 50 of the tubular string 10 is transferred to the expansion device 30 by a contact area 37 formed between an upper face of the expansion device 30 and the inner surface of the shoulder 45.

An axial force 35 is applied to the expansion device 30 via the work string 5 to pull on and axially displace the expansion device 30 through the expandable tubular string 10. The expansion device 30 in turn imparts a radial force to the inner surface of the shoulder 45 and the inner surface of the tubular string 10. In response to the radial force, the tubular string 10 plastically deforms and expands radially, thereby permanently increasing both its inner and outer diameters.

As illustrated in FIG. 1, the maximum weight 50 and corresponding length of the tubular string 10 that can be run in on the expansion device 30 is set by the expansion force required to start expansion of the tubular string 10. The area of wall thickness 40 of the shoulder 45 that is disposed at a right angle relative to the contact area 37 is the section of the shoulder 45 that holds the weight 50 of the tubular string 10. If the weight 50 of the tubular string 10 that is applied to the contact area 37 generates a force that exceeds the force required to begin expansion at the shoulder 45, then the tubular string 10 will begin to expand under its own weight 50 across the expansion device 30. To increase the amount of expandable tubular string weight 50 that can be supported by the expansion device 30, the thickness of the shoulder 45 can be increased as illustrated in FIG. 2.

Figure 2:
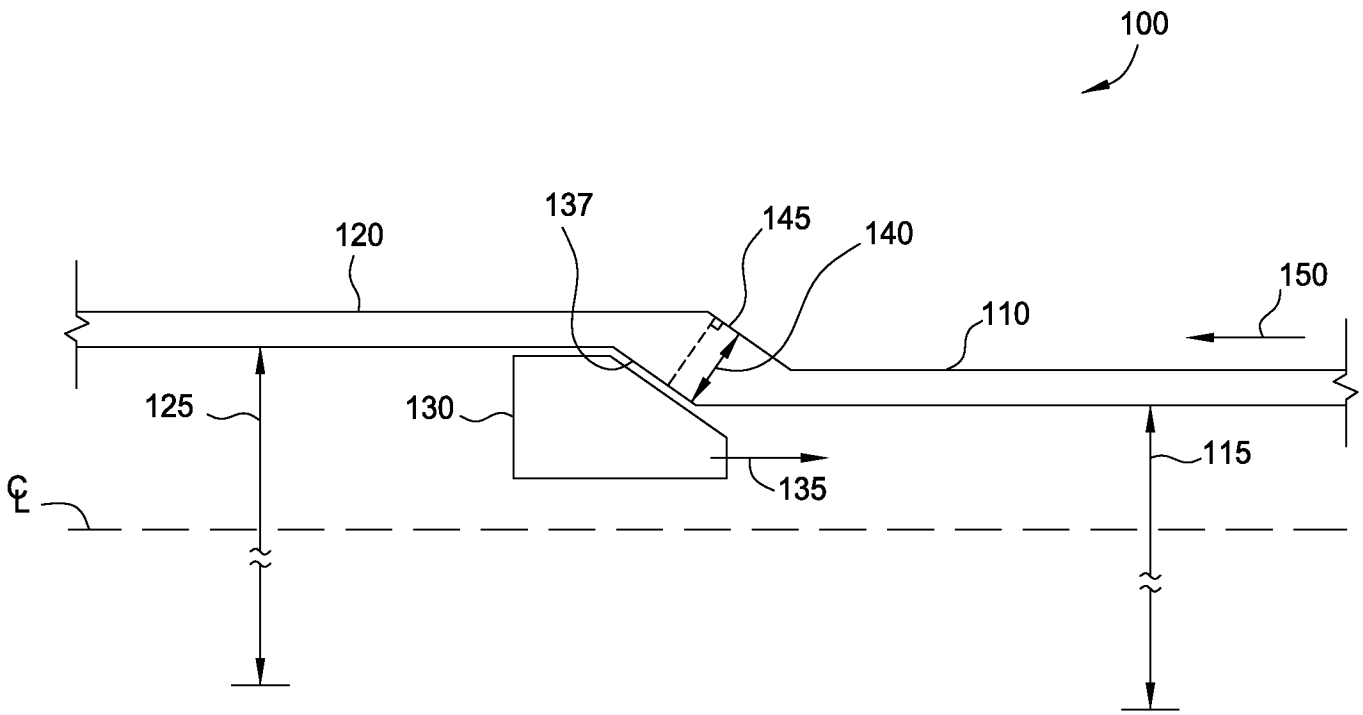
FIG. 2 illustrates one expandable tubular system supported by an expansion cone according to one embodiment.

FIG. 2 illustrates an expandable tubular system 100 according to one embodiment, the work string 5 having been removed for clarity. The components of the system 100 that are similar to the components in FIG. 1 include the same reference numerals but with a 100-series designation. As illustrated in FIG. 1, the wall thickness 140 of the shoulder 145 has been increased to increase the amount of force required to initiate expansion of the tubular string 110. Although the wall thickness 140 has been increased, the inner diameters 125, 115 and the wall thickness of the remaining launcher section 120 and the tubular string 110 may remain substantially the same and/or uniform relative to the tubular string 10. In other words, the wall thickness 140 is greater than the wall thicknesses of the launcher section 120 and tubular string 110. The wall thickness 140 has been increased along the outer surface of the shoulder 145 such that the contact area 137 also remains substantially the same as the contact area 37. The shoulder 145 can only be increased along its outer surface a predetermined amount before maximizing the amount of expansion force that can be gained for the given sizes of inner diameters 125, 115 and outer diameters of the launcher section 120 and the tubular string 110.

Figure 3:
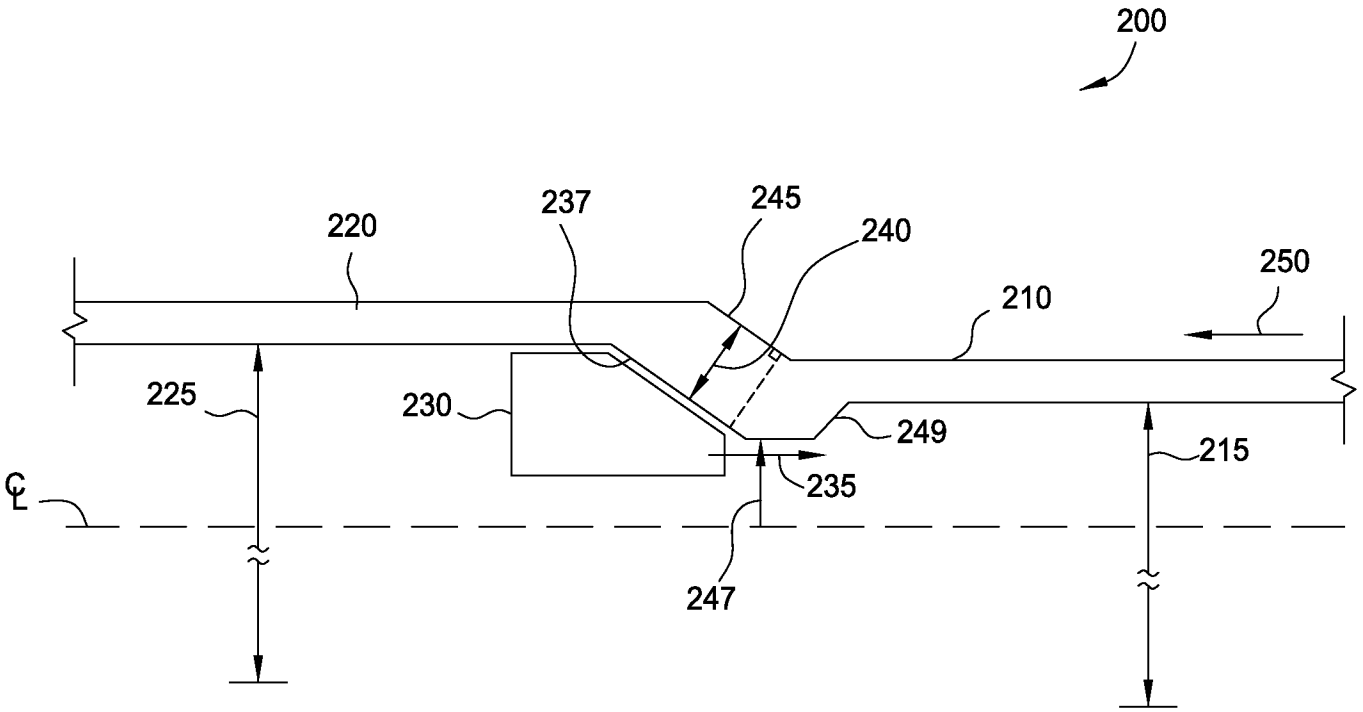
FIG. 3 illustrates another expandable tubular system supported by an expansion cone according to one embodiment.

FIG. 3 illustrates an expandable tubular system 200 according to one embodiment, the work string 5 having been removed for clarity. The components of the system 200 that are similar to the components in FIGS. 1 and 2 include the same reference numerals but with a 200-series designation. As illustrated in FIG. 3, the wall thickness 240 of the shoulder 245 has been increased to increase the amount of force required to initiate expansion of the tubular string 210. The wall thickness 240 is greater than the wall thicknesses of the launcher section 220 and tubular string 210. The wall thickness 240 has been increased along the inner surface of the shoulder 245 such that an inner shoulder 249 (or inner neck portion) is formed at the transition point between the shoulder 245 and the tubular string 210. The wall thickness 240 may be similar to or greater than the wall thickness 140 in FIG. 2.

The inner shoulder 249 has an inner diameter 247 that is less than the inner diameters 225, 215 of the launcher section 220 and the tubular string 210, respectively. In addition to the wall thickness 240, the contact area 237 between the upper face of the expansion device 230 and the shoulders 245, 249 also is increased. The increased contact area 237 further increases the amount of force required to initiate expansion of the tubular string 210. The combination of the increased wall thickness 240 and contact area 237 increases the amount of tubular string weight 250 that can supported by the expansion device 230 relative to systems having lesser shoulder wall thicknesses and contact areas for the given inner diameters 225, 215 and outer diameters of the launcher section 220 and tubular string 210. The wall thickness of the remaining launcher section 220 and the tubular string 210 may remain substantially the same and uniform relative to the tubular strings 10, 110.

Figure 4:
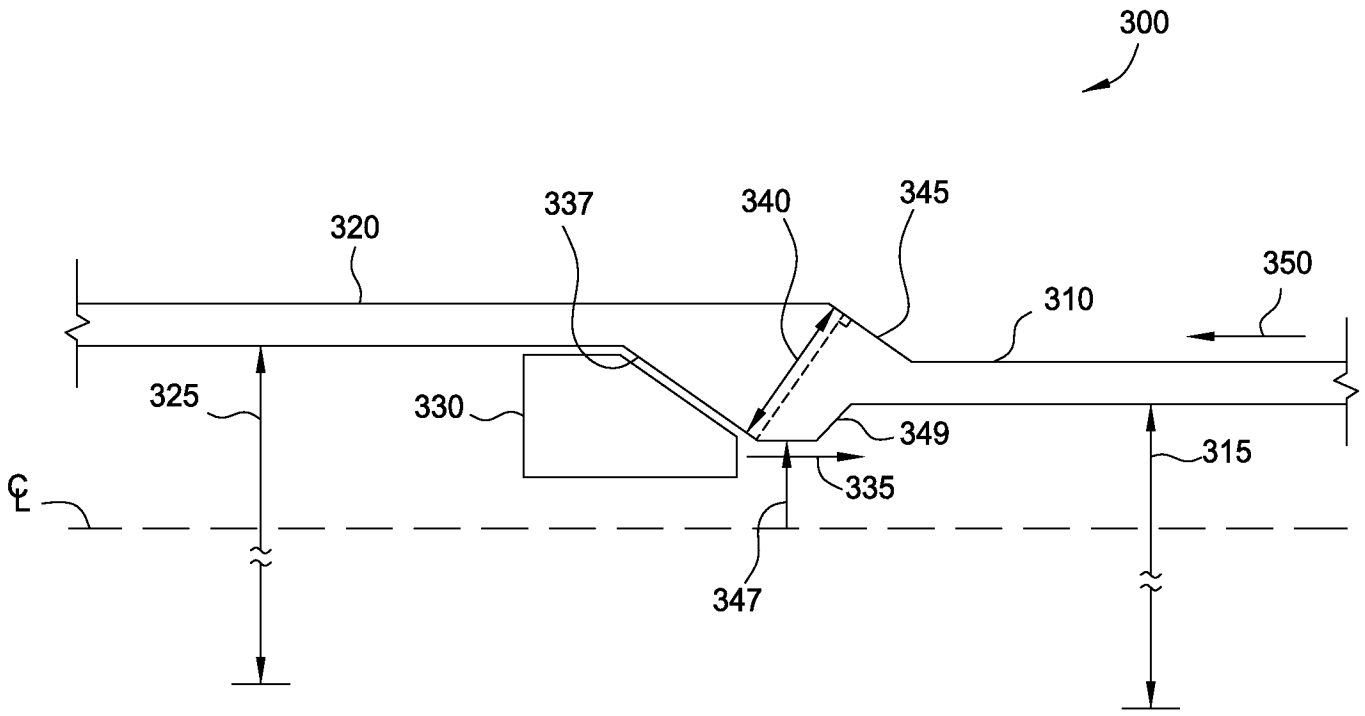
FIG. 4 illustrates even another expandable tubular system supported by an expansion cone according to one embodiment.

FIG. 4 illustrates an expandable tubular system 300 according to one embodiment, the work string 5 having been removed for clarity. The components of the system 300 that are similar to the components in FIGS. 1, 2, and 3 include the same reference numerals but with a 300-series designation. As illustrated in FIG. 4, the wall thickness 340 of the shoulder 345 has been further increased to increase the amount of force required to initiate expansion of the tubular string 310. The wall thickness 340 is greater than the wall thicknesses of the launcher section 320 and tubular string 310. The wall thickness 340 has been increased along both the outer surface and inner surface of the shoulder 345 such that the inner shoulder 349 (or inner neck portion) is formed at the transition point between the shoulder 345 and the tubular string 310. The wall thickness 340 may be greater than the wall thicknesses 140, 240 in FIGS. 2 and 3.

The inner shoulder 349 has an inner diameter 347 that is less than the inner diameters 325, 315 of the launcher section 320 and the tubular string 310, respectively. In addition to the wall thickness 340, the contact area 337 between the upper face of the expansion device 330 and the shoulders 345, 349 also is increased. The increased contact area 337 further increases the amount of force required to initiate expansion of the tubular string 310. The combination of the increased wall thickness 340 (along both outer and inner surfaces of the shoulder 345) and contact area 337 increases the amount of tubular string weight 350 that can supported by the expansion device 330 relative to systems having lesser shoulder wall thicknesses and contact areas for the given inner diameters 325, 315 and outer diameters of the launcher section 320 and tubular string 310. The wall thickness of the remaining launcher section 320 and the tubular string 310 may remain substantially the same and uniform relative to the tubular strings 10, 110, 210.

While the foregoing is directed to embodiments of the invention, other and further embodiments of the invention may be devised without departing from the basic scope thereof, and the scope thereof is determined by the claims that follow.

The invention claimed is:

1. An expandable tubular system, comprising:

an expandable tubular string having a wall thickness;

a launcher section having a wall thickness, the launcher section housing an expansion device; and a shoulder section having a wall thickness, the shoulder section connecting the launcher section and the tubular string, the wall thickness of the shoulder section being greater than the wall thicknesses of the tubular string and the launcher section, a first outer diameter of the shoulder section being no greater than an outer diameter of the launcher section and no less than an outer diameter of the tubular string, wherein the shoulder section has a second outer diameter that is different than the first outer diameter, an inner diameter of the shoulder section being less than an inner diameter of the launcher section and less than an inner diameter of the tubular string, wherein an expansion force required to expand the portion of the shoulder section having the greater wall thickness is greater than an expansion force required to expand the tubular string.

2. The system of claim 1, wherein an upper face of the expansion device contacts an inner surface of the shoulder section for supporting the weight of the tubular string from the surface via a work string.

3. The system of claim 1, wherein the launcher section, the shoulder section, and the tubular string are formed integrally with each other.

4. The system of claim 1, wherein the wall thickness of the launcher section is substantially the same as the wall thickness of the tubular string.

5. The system of claim 1, wherein the inner diameter of the launcher section is greater than the inner diameter of the tubular string.

6. The system of claim 1, wherein the wall thickness of the shoulder section varies.

7. A method of expanding a tubular string, comprising:

lowering the tubular string into a wellbore using an expansion device that is supported from the surface via a work string, wherein the expansion device is disposed in a launcher section that is coupled to the tubular string;

supporting the weight of the tubular string in the wellbore on an upper face of the expansion device, wherein the upper face of the expansion device contacts an inner surface of a shoulder section that forms a transition point between the launcher section and the tubular string, wherein the shoulder section has a wall thickness greater than wall thicknesses of the tubular string and the launcher section, wherein a first outer diameter of the shoulder section is no greater than an outer diameter of the launcher section and no less than an outer diameter of the tubular string, wherein the shoulder section has a second outer diameter that is different than the first outer diameter, and wherein an inner diameter of the shoulder section is less than an inner diameter of the launcher section and less than an inner diameter of the tubular string;

wherein the greater wall thickness at the shoulder section increases the weight supportable by the expansion device than the wall thickness of the tubular string; and expanding the tubular string using the expansion device.

8. The method of claim 7, wherein an upper face of the expansion device contacts the inner surface of the shoulder section for supporting the weight of the tubular string from the surface via a work string.

9. The method of claim 7, wherein the launcher section, the shoulder section, and the tubular string are formed integrally with each other.

10. The method of claim 7, wherein the wall thickness of the launcher section is substantially the same as the wall thickness of the tubular string.

11. The method of claim 7, wherein the inner diameter of the launcher section is greater than the inner diameter of the tubular string.

12. The method of claim 7, wherein the wall thickness of the shoulder section is not uniform.

* * * * *